US008106933B2

(12) United States Patent
Park et al.

(10) Patent No.: US 8,106,933 B2
(45) Date of Patent: Jan. 31, 2012

(54) IMAGE FORMING APPARATUS

(75) Inventors: Ju Hyun Park, Suwon-si (KR); Do Hyung Kweon, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1159 days.

(21) Appl. No.: 11/863,848

(22) Filed: Sep. 28, 2007

(65) Prior Publication Data

US 2008/0129813 A1 Jun. 5, 2008

(30) Foreign Application Priority Data

Nov. 7, 2006 (KR) ..... 10-2006-0109701

(51) Int. Cl.
*B41J 2/32* (2006.01)

(52) U.S. Cl. ..... 347/198

(58) Field of Classification Search ..... 347/198, 347/197; 400/120.16, 120.17
See application file for complete search history.

(56) References Cited

U.S. PATENT DOCUMENTS 5,846,003 A * 12/1998 Mori et al. ..... 400/120.17
2005/0024473 A1* 2/2005 Kamata ..... 347/220
2007/0291100 A1* 12/2007 Kang et al. ..... 347/220

* cited by examiner

*Primary Examiner* — Kristal Feggins
(74) *Attorney, Agent, or Firm* — Staas & Halsey LLP

(57) ABSTRACT

An image forming apparatus includes a frame that has a first side frame and a second side frame facing each other, a platen which is rotatably supported by the first side frame and the second side frame, a head to move in first or second directions to press against or separate from the platen, a head supporting member connected to the head to support the head, and an adjusting member to pivotally support opposite ends of the head supporting member, wherein one of the two ends is fixed to the first side frame, and the other of the two ends is movably coupled to the second side frame so as to be able to move relative to the fixed end in the first and second directions.

25 Claims, 7 Drawing Sheets

IMAGE FORMING APPARATUS

CROSS-REFERENCE TO RELATED APPLICATION

This application claims the benefit of Korean Application No. 2006-109701, filed Nov. 7, 2006 in the Korean Intellectual Property Office, the disclosure of which is incorporated herein by reference.

BACKGROUND OF THE INVENTION

1. Field of the Invention

Aspects of the present invention relate generally to an image forming apparatus, and more particularly, to a thermal transfer image forming apparatus with an improved structure which enables the apparatus to form high quality images.

2. Description of the Related Art

A thermal transfer image forming apparatus applies heat to an ink ribbon which contacts a print medium, such as a sheet of paper, a transparency sheet, etc., and transfers ink to the print medium, thereby forming an image. In general, the thermal transfer image forming apparatus includes a thermal head which selectively heats a plurality of heating elements to perform printing, and a platen roller which presses against the thermal head at a predetermined pressure.

This thermal transfer image forming apparatus forms high quality images only when the thermal head is pressed onto the platen roller at a uniform pressure. U.S. Patent Publication No. 2005/0024473 discloses a thermal transfer image forming apparatus which automatically adjusts the thermal head when the thermal head is not pressed onto the platen roller at a uniform pressure.

This conventional thermal transfer image forming apparatus includes a first head supporting member to support a thermal head and a second head supporting member to support two elastic members which elastically push the first head supporting member toward a platen roller. The first head supporting member includes first and second arcuate arm parts which extend from both longitudinal ends of the first head supporting member in one direction. The second head supporting member includes third and fourth arm parts which are disposed adjacent to the first and second arm parts, respectively. Specifically, one end of the first arm part is supported by one end of the third arm part such that the thermal head moves in a parallel direction to a direction in which the thermal head moves towards or away from the platen roller. The two elastic members disposed between the first and second head supporting members are designed to push the first head supporting member towards the platen roller with different elastic forces.

Therefore, when the thermal head is not in uniform contact with the platen roller due to dimensional errors of or assembly imbalance between the parts of the first and second head supporting members, the first arm part of the first head supporting member moves relative to the third arm part of the second head supporting member to automatically adjust the thermal head so that the thermal head makes uniform contact with the platen roller. Furthermore, the two elastic members elastically pushing the thermal head are designed to supply different elastic supporting forces to the thermal head, so that although the thermal head has an automatically adjustable structure, the pressure acting on both ends of the thermal head maintains uniformity.

However, in this conventional thermal transfer image forming apparatus, the one end of the first head supporting member which supports the thermal head moves freely.

Hence, the alignment of the thermal head is affected by an external impact. Specifically, when the conventional thermal transfer image forming apparatus is impacted by even a slight external force, the alignment of the thermal head fluctuates. When the alignment of the thermal head fluctuates, the contact between the thermal head and the platen roller also fluctuates, and the pressure which the thermal head applies to the platen roller changes frequently.

Furthermore, in the conventional thermal transfer image forming apparatus, when the pressure acting on both ends of the thermal head changes due to external impacts or repeated operations, the print quality become poor. Also, the pressure cannot be easily adjusted in the conventional thermal transfer image forming apparatus.

SUMMARY OF THE INVENTION

Accordingly, aspects of the present invention have been developed to solve the above-mentioned and/or other problems occurring in the prior art. An aspect of the present invention provides an image forming apparatus capable of causing a head to press a platen roller in a stable fashion, thereby obtaining a high quality image.

Another aspect of the present invention provides an image forming apparatus which a user can easily adjust to adjust pressure acting between the thermal head and the platen roller.

In order to accomplish these and/or other goals, an image forming apparatus according to an aspect of the present invention includes a frame having a first side frame and a second side frame facing each other, a head to form an image on a print medium, a head supporting member connected to the head to support the head, and an adjusting member to pivotally support the head supporting member at opposite ends thereof, wherein one portion of the adjusting member is fixed to the first side frame, and another portion of the adjusting member is movably coupled to the second side of the frame.

According to an aspect of the present invention, the frame includes an adjusting slot into which the another portion of the adjusting member is inserted to guide a movement of the another portion of the adjusting member in first and second directions.

According to an aspect of the present invention, the image forming apparatus further includes a fixing member coupled with the one portion of the adjusting member and fixed to the one side of the frame to fix the one portion of the adjusting member to the first side frame.

According to an aspect of the present invention, the fixing member is formed of an elastic material, and includes a recessed area which forms a gap between the first side frame and the fixing member to prevent the fixing member from interfering with the first side frame when the fixing member is elastically deformed. According to an aspect of the present invention, the fixing member includes a cutout area to reduce an amount of force used to elastically deform the fixing member.

According to an aspect of the present invention, the image forming apparatus further includes a platen which presses against the head when the head is moved in the second direction, and an adjusting unit which is movable in the first and second directions, and which is coupled to the another portion of the adjusting member to move the another portion of the adjusting member in the first or second direction to maintain uniform pressure between the head and the platen.

According to an aspect of the present invention, the adjusting unit includes a shaft coupling hole formed at a position corresponding to the adjusting slot, the another portion of the adjusting member extends through the adjusting slot and the shaft coupling hole, and the shaft coupling hole guides the another portion of the adjusting member in the first or second directions.

According to an aspect of the present invention, the adjusting unit includes a fastening slot through which a fastener is insertable to fix the adjusting unit to the second side frame at a position in which the pressure between the head and the platen is uniformly distributed.

According to an aspect of the present invention, the adjusting unit includes a first adjusting indentation to contact one part of a tool, and a second adjusting indentation to contact another part of the tool, and the adjusting unit moves in the first or second direction according to a rotation of the tool when the tool is inserted into the first adjusting indentation and the second adjusting indentation.

According to an aspect of the present invention, the second side frame includes a guide knob to guide a movement of the adjusting unit in the first or second direction, and the adjusting of the guide knob in the first or second direction.

According to another aspect of the present invention, an image forming apparatus includes a frame that has a first side frame and a second side frame facing each other, a platen that is rotatably supported by the first side frame and the second side frame, a head to move in a second or a first direction to press against or separate from the platen, a head supporting member connected to the head to support the head, and an adjusting member having two portions to pivotally support corresponding ends of the head supporting member, wherein one of the two portions of the adjusting member is fixed to the first side frame, and the other of the two portions is movably coupled to the second side frame so as to be able to move relative to the fixed portion in the first and second directions.

According to another aspect of the present invention, the second side frame includes an adjusting slot into which the other portion of the adjusting member is inserted so as to guide the other portion of the adjusting member to move in the first and second directions.

According to another aspect of the present invention, the image forming apparatus further includes an adjusting unit coupled with the other portion of the adjusting member to guide a movement of the adjusting member, wherein the adjusting unit comprises a fastening slot through which a fastener is insertable to fix the adjusting unit to the second side frame at a position in which pressure between the head and the platen is uniformly distributed.

According to another aspect of the present invention, the image forming apparatus further includes a fixing member coupled with the one portion of the adjusting member to fix the one portion of the adjusting member to the first side frame, wherein the fixing member elastically deforms according to a movement of the other portion of the adjusting member.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will be apparent and more readily appreciated from the following description of the embodiments, taken in conjunction with the accompanying drawings of which.

DETAILED DESCRIPTION OF THE EMBODIMENTS

Figure 1:
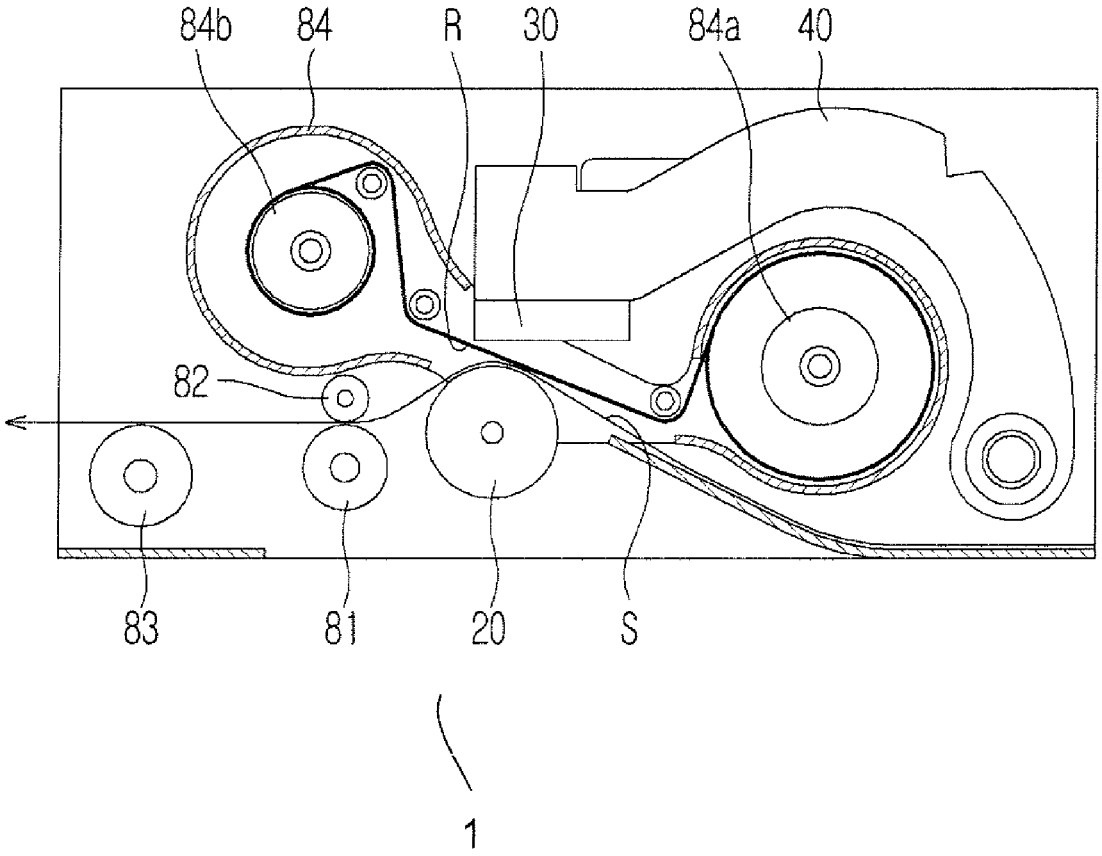
FIG. 1 is a schematic side sectional view illustrating the construction of an image forming apparatus according to an embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 2:
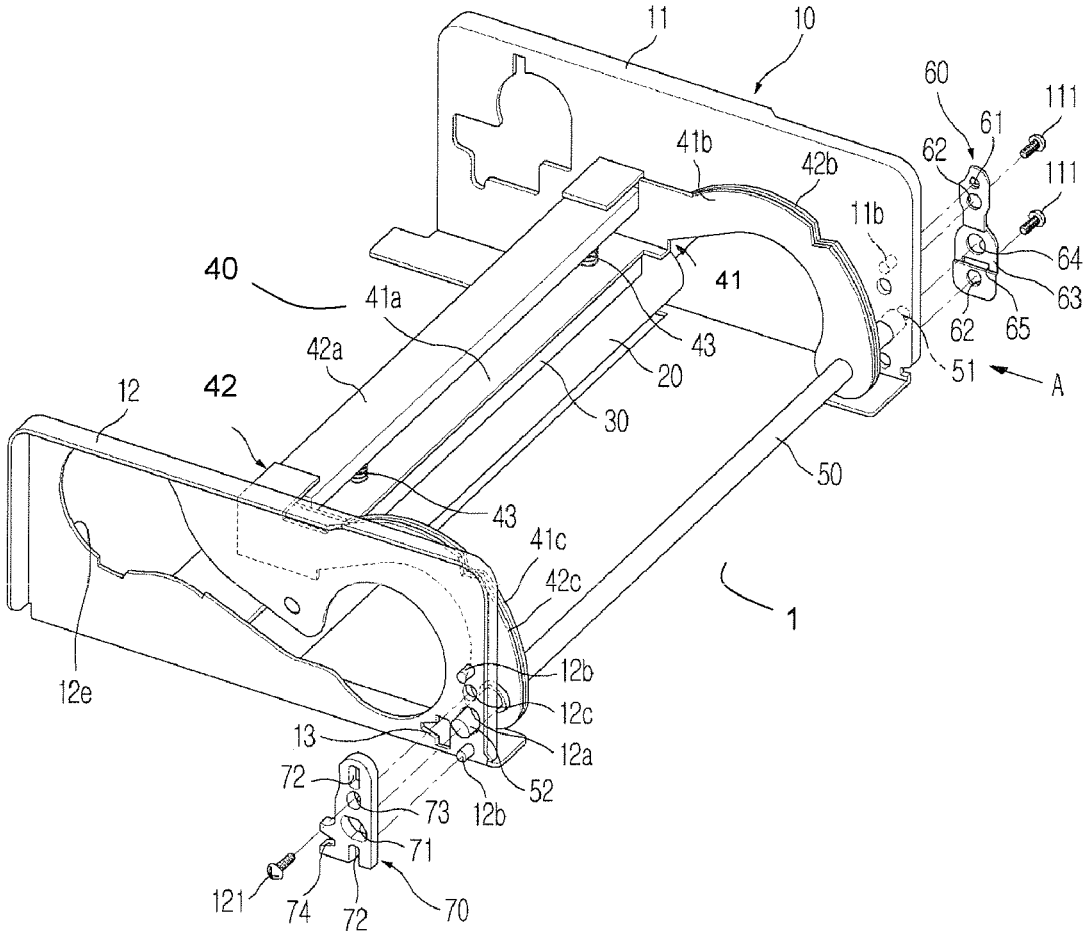
FIG. 2 is a detailed perspective view illustrating the image forming apparatus shown in FIG. 1.

FIG. 1 is a schematic side sectional view illustrating the construction of an image forming apparatus 1 according to an embodiment of the present invention, and FIG. 2 is a detailed perspective view illustrating the image forming apparatus 1 shown in FIG. 1.

As illustrated in FIGS. 1 and 2, the image forming apparatus 1 according to an embodiment of the present invention includes a frame 10 which has a first side frame 11 and a second side frame 12 facing the first side frame 11, a platen roller 20, also known as a platen, which is rotatably supported by the first and the second side frames 11 and 12, and a thermal head 30 which is disposed above the platen roller 20 and forms an image on a print medium S when the head 30 is pressed against the platen roller 20. The print medium S may be various types, such as a sheet of paper, a transparency sheet, stationary, etc.

The thermal head 30, which is also referred to as the head 30, includes a plurality of heating elements (not shown) disposed on a side of the head 30 opposite the platen roller 20. The plurality of heating elements is pressed against or separated from the platen roller 20 when the head 30 is respectively pivoted upward or downward due to a force supplied by a device which moves the head 30 up or down (not shown). It is understood that the device which moves the head 30 up and down may supply various types of forces, such as electrical forces, elastic forces, etc., to move the head 30 up and down.

As illustrated in FIG. 2, the head 30 is attached to and supported by one side of a thermal head supporting member 40, also referred to as a head supporting member 40. The head supporting member 40 includes a first head supporting member 41 which has a head support 41*a* located above the head 30 to support the head 30, and a second head supporting member 42 which has an elastic support 42*a* disposed above and apart from the head support 41*a* at a predetermined distance.

At least one elastic member 43 is installed between the head support 41*a* of the first head supporting member 41 and the elastic support 42*a* of the second head supporting member 42. The at least one elastic member 43 presses the head 30, which is supported by the head support 41*a*, toward the platen roller 20. As shown in FIG. 2, according to an aspect of the present invention, two elastic members 43 are disposed between the head support 41*a* and the elastic support 42*a*. It is understood that more than two elastic members 43 may be disposed between the head support 41*a* and the elastic support 42*a*, and that the elastic members 43 may be embodied in a variety of ways, such as coil springs, etc.

The first head supporting member 41 includes first and second arcuate arms 41*b* and 41*c*, respectively, which extend from opposite longitudinal ends of the head support 41*a*. The second head supporting member 42 includes third and fourth arms 42*b* and 42*c*, respectively, which extend from opposite longitudinal ends of the elastic support 42*a*. The third arm 42*b* is disposed adjacent to and outside of the first arm 41*b* in a direction towards the first side frame 11, while the fourth arm 42*c* is disposed adjacent to and outside of the second arm 41*c* in a direction towards the second side frame 12. The first, second, third, and fourth arms 41*b*, 41*c*, 42*b*, and 42*c*, respectively, are each supported, or connected, at one end by the opposite ends of the head 30, the head support 41*a*, and the elastic support 42*a*, and are pivotably supported at another end by opposite ends of an adjusting member 50. It is understood that the first, second, third, and fourth arms 41*b*, 41*c*, 42*b*, and 42*c*, respectively, are not all required to be connected to the opposite ends of the head 30, the head support 41*a*, the elastic support 42*a*, and the adjusting member 50, and may instead be connected to other components of the image forming apparatus 1. It is further understood that aspects of the present invention do not require the four arms 41*b*, 41*c*, 42*b*, and 42*c*, and may instead have less than or greater than four arms.

The adjusting member 50 has one end 51 constrained within the first side frame 11, and the other end 52 coupled to the second side frame 12 so as to be able to move relative to the one end 51 in upward and downward directions. When the other end 52 of the adjusting member 50 is moved in either the upward or downward direction, the head 30, which is supported by the head supporting member 40, correspondingly moves together with the other end 52 in an upward or downward direction. Therefore, a movement of the other end 52 of the adjusting member 50 in an upward or downward direction causes a corresponding adjustment in the pressure acting between the head 30 and the platen roller 20. This pressure adjustment will now be described below in detail.

Figure 3:
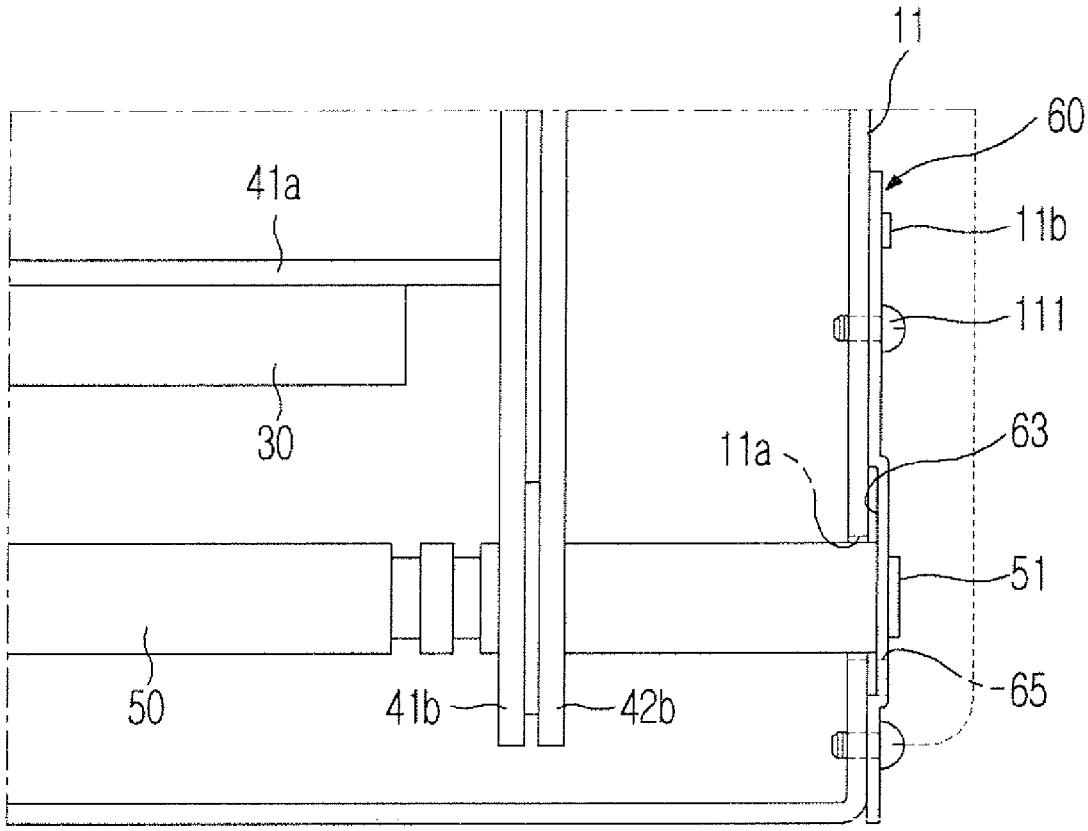
FIG. 3 is a view of the image forming apparatus shown in FIG. 2 as viewed in the direction of the arrow A shown in FIG. 2, illustrating a state where the adjusting unit and a first side frame of the image forming apparatus shown in FIG. 2 are coupled to each other.
Figure 4:
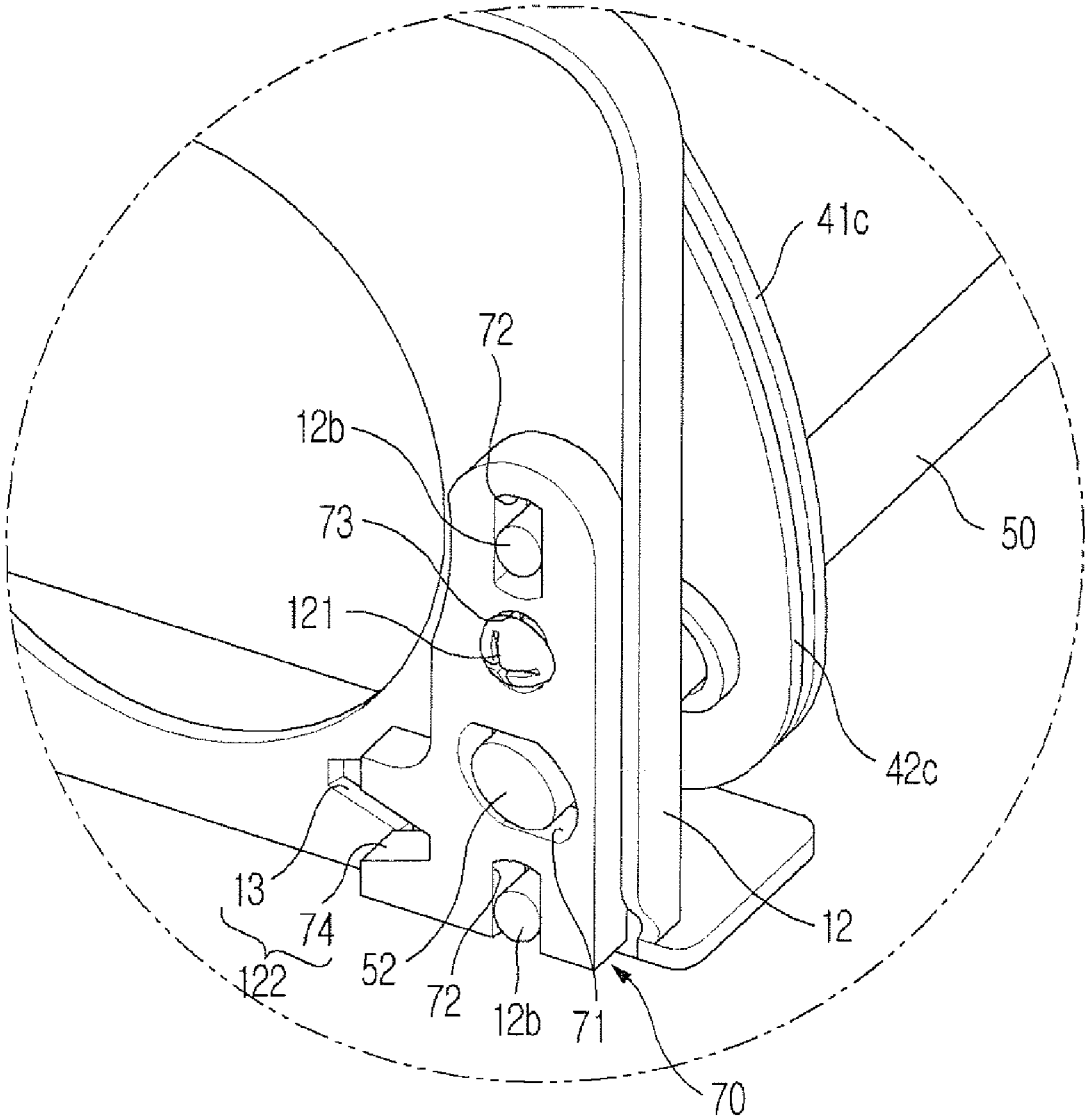
FIG. 4 is a perspective view illustrating the state where the adjusting unit and a second side frame of the image forming apparatus shown in FIG. 2 are coupled to each other.

A detailed description will now be made regarding a structure in which the adjusting member 50 is coupled with the frame 10. FIG. 3 is a view of the image forming apparatus 1 shown in FIG. 2 as viewed in the direction of the arrow A shown in FIG. 2, illustrating a state where the adjusting member 50 and the first side frame 11 are coupled to each other. FIG. 4 is a perspective view illustrating a state where the adjusting member 50 and the second side frame 12 of the image forming apparatus 1 shown in FIG. 2 are coupled to each other. In FIG. 3, the platen roller 20 is not illustrated. It is understood that the adjusting member 50 is not required to be embodied as a single cylindrical shaft in all aspects of the present invention, and that other devices, such as, for example, cables or a plurality of cylindrical shafts, may be used instead of a single cylindrical shaft to achieve similar results.

As illustrated in FIGS. 2, 3 and 4, the one end 51 of the adjusting member 50 extends through and beyond the first side frame 11, while the other end 52 of the adjusting member 50 extends through and beyond the second side frame 12. Specifically, the one end 51 extends through a through-hole 11*a* formed in the first side frame 11, and the other end 52 extends through an adjusting slot 12*a* (see FIGS. 5A and 5B) in the second side frame 12. The adjusting slot 12*a* enables the other end 52 of the adjusting member 50 to be movable in up and down directions relative to the one end 51. According to an aspect of the present invention, the through-hole 11*a* is formed to have a diameter which is slightly greater than the diameter of the adjusting member 50 inserted in the through-hole 11*a*. The diameter of the through-hole 11*a* is formed to be slightly larger than the diameter of the adjusting member 50 to take into consideration that the one end 51 of the adjusting member 50 moves a slight amount when the other end 52 of the adjusting member 50 moves in an upward or downward direction. However, it is understood that the diameter of the through-hole 11*a* may also be formed to be the same diameter as the diameter of the adjusting member 50.

An outer side of the first side frame 11 is coupled with a fixing member 60 which fixes the one end 51 of the adjusting member 50 to the first side frame 11. As illustrated in FIGS. 2 and 3, the fixing member 60 includes a guide hole 61 which is formed around a circumference of a first guide knob 11*b* disposed on the outer side of the first side frame 11 to hold the fixing member 60 in place, and a fastening hole 62 into which a screw 111 is inserted to fasten the fixing member 60 to the first side frame 11. It is understood that the fixing member 60 is not limited to using a screw 111, and may instead use various other types of fasteners, such as bolts, clips, etc., known in the art.

The fixing member 60 is made of a thin material which is elastically deformable while also maintaining a high level of rigidity, such as a thin sheet of stainless steel, plastic, etc., and includes a flat surface area and a recess 63 which is spaced a predetermined distance apart from the first side frame 11 when the fixing member 60 is fixed to the first side frame 11. The recess 63 includes a shaft fixing hole 64 into which the one end 51 of the adjusting member 50 is inserted and fixed, and a cutout 65 which is a rectangular hole cut out from the recess 63 in a horizontal direction so as to allow the fixing member 60 to elastically deform with ease. It is understood that the cutout 65 is not limited to being a rectangular hole, and may instead be various other shapes, such as curved shapes.

When the other end 52 of the adjusting member 50 is moved up and down in the state where one end 51 of the adjusting member 50 is constrained by the fixing member 60, both the fixing member 60 and the first side frame 11 coupled to the fixing member 60 are under stress. At this time, the fixing member 60 is elastically deformed according to a magnitude of external force applied to the other end 52, thereby preventing the fixing member 60 and the first side frame 11 from breaking due to an excess of stress. Furthermore, the recess 63 prevents the fixing member 60 from interfering with the neighboring first side frame 11, thereby enabling the fixing member to elastically deform in a smooth manner.

In addition, as illustrated in FIGS. 2, 4, 5A, and 5B, the image forming apparatus 1 according to an aspect of the present invention includes an adjusting unit 70 which supports the other end 52 of the adjusting member 50 and guides the other end 52 of the adjusting member 50 to a desired position while a user moves the other end 52 up and down. The adjusting unit 70 includes a shaft coupling hole 71, which is formed at a position corresponding to the adjusting slot 12*a* of the second side frame 12, and into which the other end 52 of the adjusting member 50 is inserted. The shaft coupling hole 71 supports the adjusting member 50 and guides the adjusting member 50 in upward and downward directions when the one end 52 of the adjusting member 50 is inserted into the shaft coupling hole 71. Therefore, as the adjusting unit 70 moves up and down, the adjusting member 50 moves up and down as well.

Furthermore, the adjusting unit 70 includes at least one guide slot 72 which is formed to fit around at least one second guide knob 12*b* disposed on the second side frame 12, and a fastening slot 73 which is formed at a position corresponding to a fastening hole 12*c*, formed in the second side frame 12, and into which a fastener 121, such as a screw, is inserted when the adjusting unit 70 is fixed to the second side frame 12. The second guide knob 12*b* and the guide slot 72 guide the movement of the adjusting unit 70 in a straight path when a user moves the adjusting unit 70 up and down. As shown in FIG. 4, the adjusting unit 70 according to an aspect of the present invention includes two guide slots 72 which are formed to fit around two second guide knobs 12*b*.

Figure 5A:
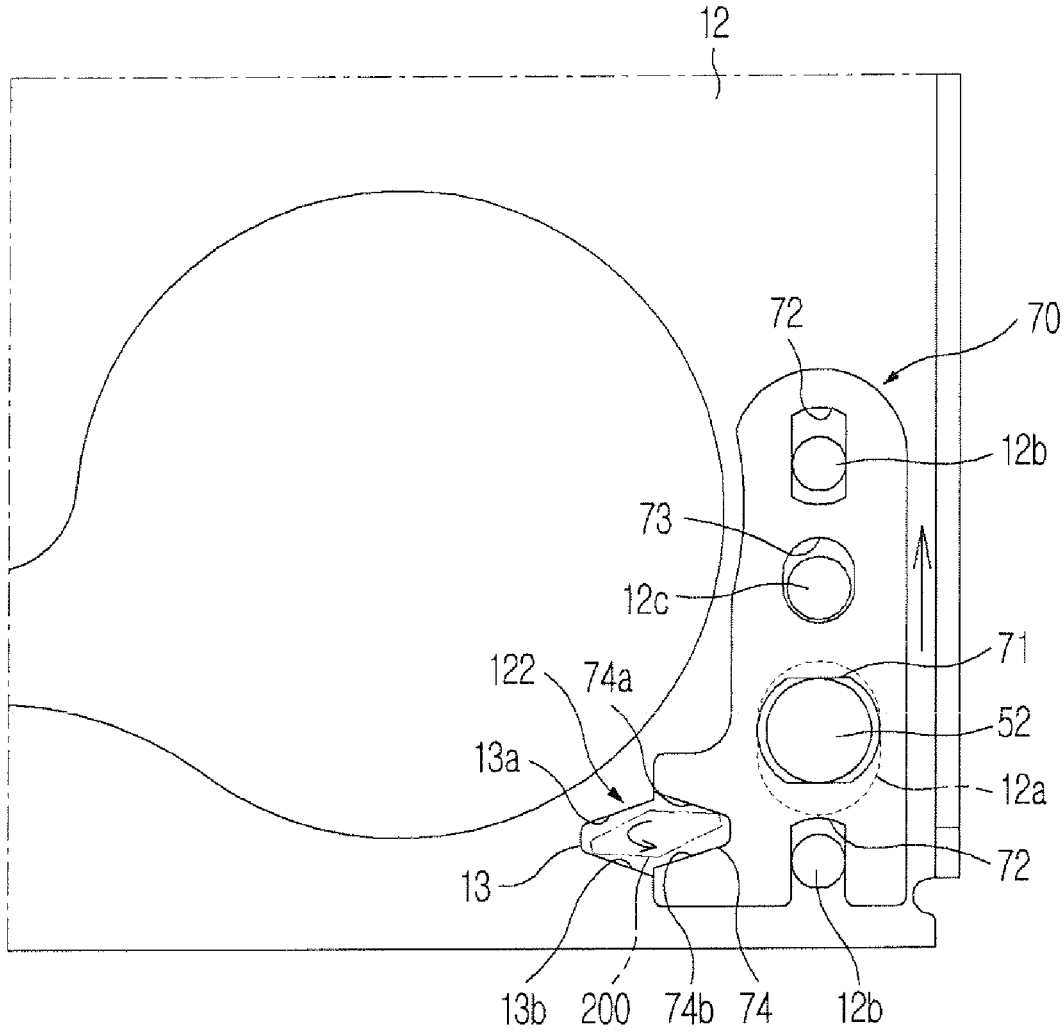
FIGS. 5A, 5B, and 6 are views illustrating a method of adjusting pressure acting between a head and a platen according to an embodiment of the present invention.
Figure 5B:
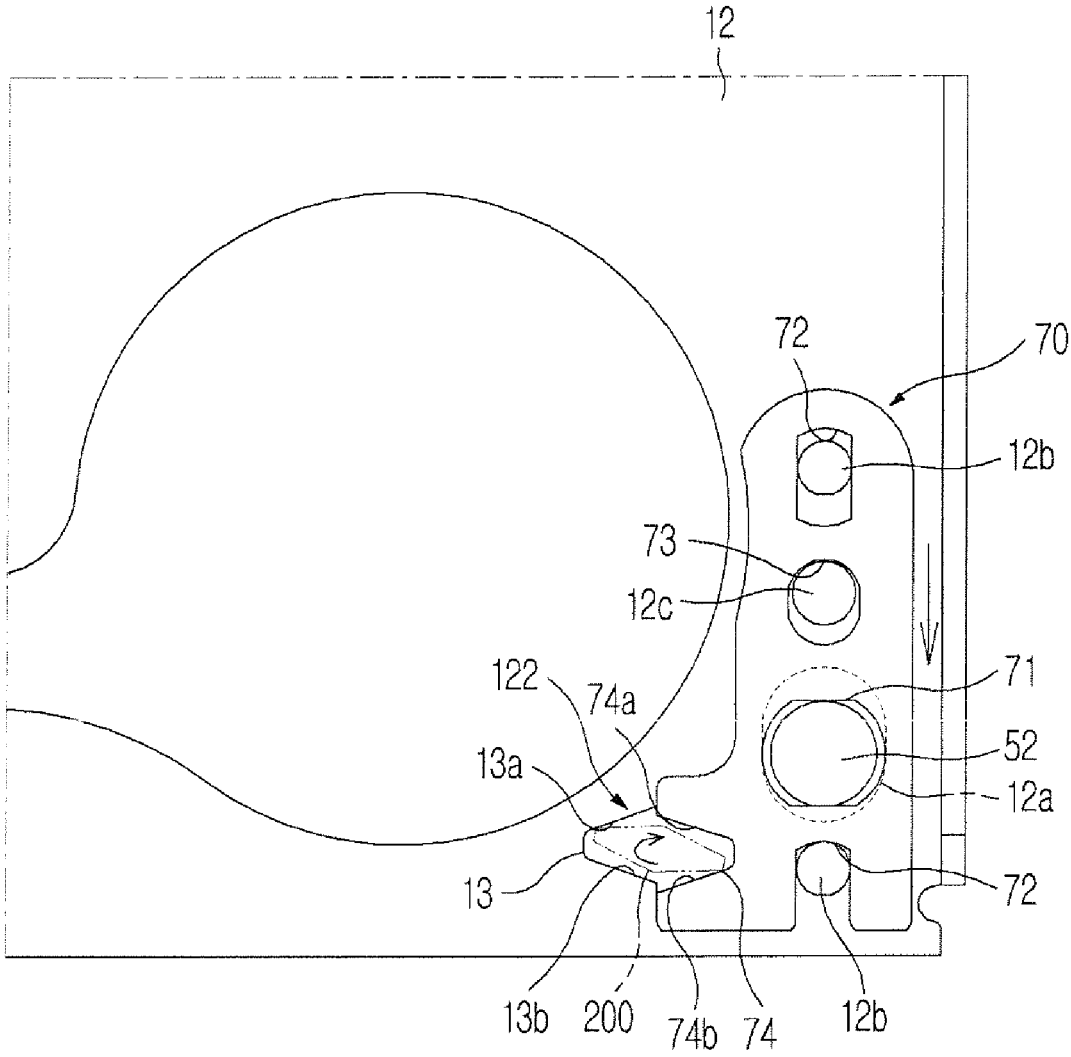

In addition, the adjusting unit 70 includes a first adjusting indentation 74, which has a shape designed to contact one part of a tool 200 (see FIGS. 5A and 5B), such as a screwdriver, alien wrench, etc. A user inserts the tool 200 into the first adjusting indentation 74 to adjust a movement of the adjusting member 50 in upward and downward directions. The second side frame 12 includes a second adjusting indentation 13, which is formed at a position corresponding to the first adjusting indentation 74, and is designed to contact another part of the tool 200. When the adjusting unit 70 is coupled to the second side frame 12, the first adjusting indentation 74 and the second adjusting indentation 13 are formed into one adjusting hole 122 (as shown in FIGS. 5A and 5B). The tool 200 is inserted into the one adjusting hole 122 to adjust the alignment of the head 30 according to a rotation of the tool 200, as will be described below.

As illustrated in FIG. 1, a transfer roller 81 and a pressure roller 82, which press against the transfer roller 81 at a predetermined pressure, are installed near the platen roller 20. A print medium discharge roller 83 to discharge the printed print medium S is installed past the transfer roller 81 along a delivery direction of the print medium S. The delivery direction of the print medium S is substantially perpendicular to a direction in which the print medium S passes the platen roller 20 and the head 30. Furthermore, an ink ribbon cassette 84 is mounted through a cassette mounting hole 12*e* (see FIG. 2) formed in the second side frame 12. An ink ribbon R is inserted into the ink ribbon cassette 84, and is wound around a supply reel 84*a* and a take-up reel 84*b*, which collectively rotate the ink ribbon R to transfer an image to the print medium S.

Figure 6:
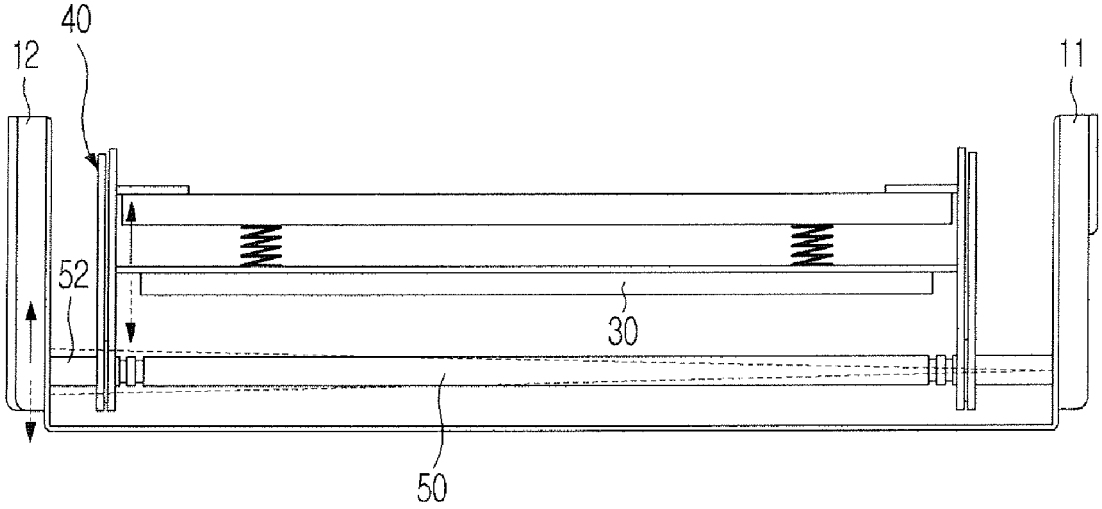

Hereinafter, an operation of the image forming apparatus 1 according to an aspect of the present invention and a method of adjusting pressure between the head 30 and the platen roller 20 will be described with reference to FIGS. 1, 2, 5A, 5B, and 6. FIGS. 5A, 5B, and 6 are views illustrating a method of adjusting pressure acting between the head 30 and the platen roller 20.

When the device used to move the head 30 up and down (not shown) is driven to rotate the head supporting member 40 in an upward direction, the head 30 moves upwards and is separated from the platen roller 20. In this state where the head 30 is separate from the platen roller 20, the ink ribbon cassette 84 is mounted so that the ink ribbon R is located between the head 30 and the platen roller 20. A leading edge of the print medium S is fed between the ink ribbon R and the platen roller 20, and then is nipped between the transfer roller 81 and the pressure roller 82. Then, the head supporting member 40 is rotated downwards due to force supplied by the device which moves the head 30 up and down, and is pressed against the platen roller 20. The heating elements of the head 30 are selectively heated according to printing information transmitted from a host, such as a computer, etc., and thermally transfer the ink from the ink ribbon R to the print medium S. In this manner, the ink ribbon R thermally transfers a desired image to the print medium S, and then the printed print medium S is discharged outside of the image forming apparatus 1 by the print medium discharge roller 83.

When the pressure with which the head 30 presses the platen roller 20 changes, for example, due to an external impact or repeated printing operations, images are not printed in a uniform manner. To correct this non-uniform printing, the pressure with which the head 30 presses the platen roller 20 is adjusted by the following method. Hereinafter, for convenience, the side of the first side frame 11 will be referred to as the left-hand side, and the side of the second side frame 12 will be referred to as the right-hand side.

First, a user loosens the screw 121 fixing the adjusting unit 70 to the second side frame 12, thereby making the adjusting unit 70 movable in an upward and downward direction, as shown in FIGS. 5A and 5B. Meanwhile, the user installs a pressure measurement device (not shown), such as a load cell, to measure the pressure between the head 30 and the platen roller 20. According to an aspect of the present invention, the pressure is measured at two or more positions. However, it is understood that the pressure may be measured at only one position, and it is further understood that the pressure measurement device is not required to be used at all.

If it is determined that the pressure between the head 30 and the platen roller 20 is greater on the right-hand side than the left-hand side, the tool 200, such as a screwdriver, is inserted into the adjusting hole 122, which has a perimeter defined by boundaries of the first adjusting indentation 74 and the second adjusting indentation 13. The tool 200 is then turned in a counterclockwise direction, as shown in FIG. 5A. When the tool 200 is turned counterclockwise, one side of the tool 200 presses against an upper surface 74*a* of the first adjusting indentation 74, and the other side of the tool 200 presses against a lower surface 13*b* of the second adjusting indentation 13, thereby pushing the adjusting unit 70 upwards. As the adjusting unit 70 moves upwards, the other end 52 of the adjusting member 50, which is inserted into the adjusting slot 12*a*, moves upwards together with the adjusting unit 70. Thus, the head 30, which is supported by the head supporting member 40, moves upwards as well in a direction indicated by the two arrows with solid lines shown in FIG. 6, in a direction away from the platen roller 20. Thus, the pressure between the head 30 and the platen roller 20 decreases on the right-hand side. At this time, the worker checks the pressure between the head 30 and the platen roller 20 using the pressure measurement device, and then fixes the adjusting unit 70 to the second side frame 12 by tightening the screw 121 at the position where the pressure between the head 30 and the platen roller 20 on the left-hand side is substantially the same as the pressure between the head 30 and the platen roller 20 on the right-hand side to lock the head 30 into the position.

In contrast, if it is determined that the pressure between the head 30 and the platen roller 20 on the left-hand side is greater than the pressure between the head 30 and the platen roller 20 on the right-hand side, the tool 200, such as a screwdriver, is inserted into the adjusting hole 122, which has a perimeter defined by the boundaries of the first adjusting indentation 74 and the second adjusting indentation 13, and then is turned in a clockwise direction, as shown in FIG. 5B. Then, one side of the tool 200 presses against a lower surface 74*b* of the first adjusting indentation 74, and the other side of the tool 200 presses against an upper surface 13*a* of the second adjusting indentation 13. This clockwise rotation of the tool 200 pushes the adjusting unit 70 downward. As the clockwise rotation of the tool 200 pushes the adjusting unit 70 downward, the other end 52 of the adjusting member 50 moves downwards together with the adjusting unit 70. Thus, the head 30, which is supported by the head supporting member 40, moves downward as well in a direction indicated by the two arrows with dotted lines illustrated in FIG. 6, in a direction towards the platen roller 20. As the head 30 moves downward, the pressure between the head 30 and the platen roller 20 increases on the right-hand side. At this time, the worker checks the pressure between the head 30 and the platen roller 20 using the pressure measurement device, and then fixes the adjusting unit 70 to the second side frame 12 by tightening the screw 121 at a position where the pressure between the head 30 and the platen roller 20 on the left-hand side is substantially the same as the pressure between the head 30 and the platen roller 20 on the right-hand side to lock the head 30 into the position.

As described above, according to aspects of the present invention, the head supporting member 40, which supports the head 30, is connected to and firmly supported by the first side frame 11 and the second side frame 12 through the adjusting member 50, the fixing member 60, and the adjusting unit 70, so that the pressure between the head 30 and the platen roller 20 is maintained in a stable fashion. Therefore, the image forming apparatus 1 reliably produces high quality images.

Furthermore, when external impacts or repeated printing operations disrupt the uniformity of the pressure between the head 30 and the platen roller 20 and deteriorate a quality of images, the image forming apparatus 1 according to aspects of the present invention enables a user to easily adjust the pressure, thereby improving the image quality. Additionally, it is understood that although the image forming apparatus 1 has an adjusting member 50 with one end 51 which is fixed to the first side frame 11, the one end 51 is not required to be fixed to the first side frame 11, and may instead have a similar configuration as the configuration of the second end 52 which is movably coupled to the second side frame 12.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An image forming apparatus comprising:

a frame having a first side frame and a second side frame facing each other;

a head to form an image on a print medium;

a head supporting member connected to the head to support the head; and an adjusting member to pivotally support the head supporting member at opposite portions thereof, wherein the head supporting member is coupled to the adjusting member at one end thereof, to be rotatable about the adjusting member, and wherein one portion of the adjusting member is fixed to the first side frame, and another portion of the adjusting member is movably coupled to the second side frame.

2. The image forming apparatus as claimed in claim 1, wherein the second side frame includes an adjusting slot into which the another portion of the adjusting member is inserted to guide a movement of the another portion of the adjusting member in first and second directions.

3. The image forming apparatus as claimed in claim 2, further comprising:

a platen which presses against the head when the head is moved in the second direction; and an adjusting unit which is movable in the first and second directions, and which is coupled to the another portion of the adjusting member to move the another portion of the adjusting member in the first or second direction to maintain uniform pressure between the head and the platen.

4. The image forming apparatus as claimed in claim 3, wherein the adjusting unit comprises a shaft coupling hole formed at a position corresponding to the adjusting slot, the another portion of the adjusting member extends through the adjusting slot and the shaft coupling hole, and the shaft coupling hole guides the another portion of the adjusting member in the first and second directions.

5. The image forming apparatus as claimed in claim 3, wherein the adjusting unit comprises a fastening hole through which a fastener is insertable to fix the adjusting unit to the second side frame at a position in which the pressure between the head and the platen is uniformly distributed.

6. The image forming apparatus as claimed in claim 3, wherein the adjusting unit comprises a first adjusting indentation to contact one part of a tool, the second side frame comprises a second adjusting indentation to contact another part of the tool, and the adjusting unit moves in the first or second direction according to a rotation of the tool when the tool is inserted into the first adjusting indentation and the second adjusting indentation.

7. The image forming apparatus as claimed in claim 3, wherein the second side frame comprises a guide knob to guide a movement of the adjusting unit in the first or second direction, and the adjusting unit comprises a guide slot which the guide knob is inserted into and which guides the movement of the guide knob in the first or second direction.

8. The image forming apparatus as claimed in claim 1, further comprising a fixing member coupled with the one portion of the adjusting member and fixed to the first side frame to fix the one portion of the adjusting member to the first side frame.

9. The image forming apparatus as claimed in claim 8, wherein the fixing member comprises an elastic material.

10. The image forming apparatus as claimed in claim 9, wherein the fixing member comprises a recessed area which forms a gap between the first side frame and the fixing member to prevent the fixing member from interfering with the first side frame when the fixing member is elastically deformed.

11. The image forming apparatus as claimed in claim 9, wherein the fixing member comprises a cutout area to reduce an amount of force used to elastically deform the fixing member.

12. An image forming apparatus comprising:

a frame having a first side frame and a second side frame facing each other;

a platen rotatably supported by the first side frame and the second side frame;

a head to move in a second or a first direction to press against or separate from the platen;

a head supporting member connected to the head to support the head; and an adjusting member having two portions to pivotally support corresponding ends of the head supporting member, wherein the head supporting member is coupled to the adjusting member at one end thereof, to be rotatable about the adjusting member, and wherein one of the two portions of the adjusting member is fixed to the first side frame, and the other of the two portions of the adjusting member is movably coupled to the second side frame so as to be able to move relative to the fixed portion in the first and second directions.

13. The image forming apparatus as claimed in claim 12, wherein the second side frame comprises an adjusting slot into which the other portion of the adjusting member is inserted so as to guide the other portion of the adjusting member to move in the first and second directions.

14. The image forming apparatus as claimed in claim 12, further comprising an adjusting unit coupled with the other portion of the adjusting member to guide a movement of the adjusting member, wherein the adjusting unit comprises a fastening slot through which a fastener is insertable to fix the adjusting unit to the second side frame at a position in which pressure between the head and the platen is uniformly distributed.

15. The image forming apparatus as claimed in claim 14, wherein the adjusting unit comprises a shaft coupling hole to guide the other portion of the adjusting member in the first and second directions.

16. The image forming apparatus as claimed in claim 14, wherein the adjusting unit comprises a first adjusting indentation to contact one part of a tool, the second side frame comprises a second adjusting indentation to contact another part of the tool, and the adjusting unit moves in the first or second direction according to a rotation of the tool when the tool is inserted into the first adjusting indentation and the second indentation.

17. The image forming apparatus as claimed in claim 12, further comprising a fixing member coupled with the one portion of the adjusting member to fix the one portion of the adjusting member to the first side frame, wherein the fixing member elastically deforms according to a movement of the other portion of the adjusting member.

18. The image forming apparatus as claimed in claim 17, wherein the fixing member comprises a recessed area which forms a gap between the first side frame and the fixing member to prevent the fixing member from interfering with the first side frame when the fixing member is elastically deformed.

19. The image forming apparatus as claimed in claim 17, wherein the fixing member comprises a cutout area to reduce an amount of force used to elastically deform the fixing member.

20. An image forming apparatus comprising:

a head to press an ink ribbon into a print medium to form an image;

a platen to contact the head when the head presses the ink ribbon;

an adjusting member having two portions which are coupled to corresponding ends of the head to lock the head in a position, wherein pressure between the head and the platen changes according to a movement of the adjusting member;

a first side frame which supports one of the portions of the adjusting member and a second side frame which supports the other of the portions of the adjusting member; and a fixing member coupled to the one portion of the adjusting member to fix the one portion of the adjusting member to the first side frame, wherein the fixing member elastically deforms according to the movement of the adjusting member, wherein the one portion of the adjusting member is fixed to the first side frame, and the other portion of the adjusting member is movably coupled to the second side frame.

21. The image forming apparatus according to claim 20, wherein the fixing member comprises:

a recessed area which forms a gap between the first side frame and the fixing member to prevent the fixing member from interfering with the first side frame when the fixing member is elastically deformed; and a cutout area to reduce an amount of force used to elastically deform the fixing member.

22. An image forming apparatus comprising:

a head to press an ink ribbon into a print medium to form an image;

a platen to contact the head when the head presses the ink ribbon;

an adjusting member having two portions which are coupled to corresponding ends of the head to lock the head in a position, wherein pressure between the head and the platen changes according to a movement of the adjusting member;

a first side frame which supports one of the portions of the adjusting member and a second side frame which supports the other of the portions of the adjusting member; and an adjusting unit which is movable in the first and second directions, wherein the other portion of the adjusting member is movably coupled to the second side frame by the adjusting unit, wherein the one portion of the adjusting member is fixed to the first side frame, and the other portion of the adjusting member is movably coupled to the second side frame, wherein the second side frame comprises an adjusting slot into which the other portion of the adjusting member is inserted to guide the other portion of the adjusting member in first and second directions, wherein the adjusting unit comprises a shaft coupling hole formed at a position corresponding to the adjusting slot, the other portion of the adjusting member extends through the adjusting slot and the shaft coupling hole, and the shaft coupling hole guides the other portion of the adjusting member in the first and second directions, wherein the adjusting unit comprises a fastening slot through which a fastener is insertable to fix the adjusting unit to the second side frame at a position in which the pressure between the head and the roller is uniformly distributed, and wherein the adjusting unit comprises a first adjusting indentation to contact one part of a tool, the second side frame comprises a second adjusting indentation to contact another part of the tool, and the adjusting unit moves in the first or second direction according to a rotation of the tool when the tool is inserted into an adjusting hole formed by boundaries of the first adjusting indentation and the second indentation.

23. A method of adjusting pressure between a head and a platen in a thermal transfer image forming apparatus which prints an image on a print medium, comprising:

measuring pressure between the head and the platen when the head is pressed into the platen; and adjusting the pressure by adjusting an adjusting member coupled to opposite ends of the head according to the measuring, wherein the adjusting comprises:

fixing one portion of the adjusting member to a first side frame; and moving another portion of the adjusting member, which is movably coupled to a second side frame facing the first side frame, in an first or second direction to respectively decrease or increase the pressure between the head and the platen at the second side frame, and wherein the fixing comprises coupling the one portion of the adjusting member to the first side frame using a fixing member comprising a flat elastically deformable material which is elastically deformed by the moving of the another portion of the adjusting member.

24. A method of adjusting pressure between a head and a platen in a thermal transfer image forming apparatus which prints an image on a print medium, comprising:

measuring pressure between the head and the platen when the head is pressed into the platen; and adjusting the pressure by adjusting an adjusting member coupled to opposite ends of the head according to the measuring, wherein the adjusting comprises:

fixing one portion of the adjusting member to a first side frame; and moving another portion of the adjusting member, which is movably coupled to a second side frame facing the first side frame, in an first or second direction to respectively decrease or increase the pressure between the head and the platen at the second side frame, wherein the second side frame includes an adjusting slot into which the another portion of the adjusting member is inserted to guide a movement of the another portion of the adjusting member in first and second directions, and wherein the moving comprises moving an adjusting unit, which has a guide slot corresponding to a guide knob disposed on the second side frame to guide the adjusting unit, in the first or second direction.

25. A method of adjusting pressure between a head and a platen in a thermal transfer image forming apparatus which prints an image on a print medium, comprising:

measuring pressure between the head and the platen when the head is pressed into the platen; and adjusting the pressure by adjusting an adjusting member coupled to opposite ends of the head according to the measuring, wherein the adjusting comprises:

fixing one portion of the adjusting member to a first side frame; and moving another portion of the adjusting member, which is movably coupled to a second side frame facing the first side frame, in an first or second direction to respectively decrease or increase the pressure between the head and the platen at the second side frame, wherein the moving comprises moving an adjusting unit, which has a guide slot corresponding to a guide knob disposed on the second side frame to guide the adjusting unit, in the first or second direction, and wherein the moving further comprises:

inserting a tool into an adjusting hole formed by boundaries of a first adjusting indentation located on the adjusting unit and a second adjusting indentation located on the second side frame; and rotating the tool in a counterclockwise or clockwise direction to respectively move the another portion of the adjusting member in the first or second direction.

* * * * *